US007860261B2

(12) United States Patent
Beilin

(10) Patent No.: US 7,860,261 B2
(45) Date of Patent: Dec. 28, 2010

(54) METHOD FOR HEARING AID IDENTIFICATION AND HEARING AID WITH VISUAL IDENTIFICATION

(75) Inventor: Joel Beilin, Smørum (DK)

(73) Assignee: Oticon A/S, Smorum (DK)

( * ) Notice: Subject to any disclaimer, the term of this patent is extended or adjusted under 35 U.S.C. 154(b) by 1206 days.

(21) Appl. No.: 11/430,822

(22) Filed: May 10, 2006

(65) Prior Publication Data

US 2006/0256987 A1 Nov. 16, 2006

(30) Foreign Application Priority Data

May 11, 2005 (EP) ..... 05103923

(51) Int. Cl.
*H04R 25/00* (2006.01)

(52) U.S. Cl. ..... 381/312; 381/315

(58) Field of Classification Search ..... 381/312, 381/315, 322, 323, 328, 380
See application file for complete search history.

(56) References Cited

U.S. PATENT DOCUMENTS 4,224,482 A * 9/1980 Lese et al. ..... 381/172
4,379,988 A * 4/1983 Mattatall ..... 381/323
5,210,803 A 5/1993 Martin et al.
5,253,300 A * 10/1993 Knapp ..... 381/328
5,266,919 A * 11/1993 Cook et al. ..... 381/60

FOREIGN PATENT DOCUMENTS

| | | |
|---|---|---|
| JP | 0670398 | 3/1994 |
| JP | 2001224097 | 8/2001 |
| WO | 2004110098 | 12/2004 |

OTHER PUBLICATIONS

Patent Abstracts of Japan, vol. 2000, No. 25, Apr. 12, 2001 of JP 2001 224097, to N. Kenji, entitled "Ear Hung Hearing Aid."
Patent Abstracts of Japan, vol. 018, No. 320, Jun. 17, 1994 of JP 06 070398 to M. Katsunobu, entitled "Hearing Aid and Its Manufacture."

* cited by examiner

*Primary Examiner*—Suhan Ni
(74) *Attorney, Agent, or Firm*—Birch, Stewart, Kolasch & Birch, LLP

(57) ABSTRACT

The invention relates to a hearing aid with an identification element (4) for visual identification of the hearing aid (1). According to the invention the hearing aid comprises a programmable signal processor (2), a battery (3) connectable to the signal processor (2), a light emitting element (4) and a switch (5) for controlling power supply to the light emitting element (4) controllable from the signal processor (2). The signal processor (2) is adapted to supply a power signal to the light emitting element (4) indicative of the identity of the hearing aid. The invention also relates to a method for indicating the identity of the hearing aid by the use of a visible light indicator.

9 Claims, 1 Drawing Sheet

METHOD FOR HEARING AID IDENTIFICATION AND HEARING AID WITH VISUAL IDENTIFICATION

AREA OF THE INVENTION

The invention regards a method for identification of a hearing aid, such that the user knows whether the hearing aid is adapted for the left or for the right ear.

BACKGROUND OF THE INVENTION

Indication on a hearing aid to let the user know whether the hearing aid is for the left or for the right ear is usually provided on hearing aids of the kind for wearing behind the ear (BTE). This indication can be in the form of a coloured "dot" having one colour for left and another for the right ear hearing aid. The dot can be difficult to spot for especially elderly users of hearing aids. Further the dot is provided during production and when the dot is applied the hearing aid is dedicated to being either left or right. It would be an advantage if the left/right choice of the hearing aid could be made at a later state, eg during or just prior to fitting the hearing aid to an individual. Further it should be noted that the marking is only needed by the user when the hearing aid is to be positioned on or behind the ear, at other times the marking has no function. Thus a marking is desired, which is only visible when needed, and which may be applied during or right prior to the customarysation of the hearing aid to the individual user.

SUMMARY OF THE INVENTION

The invention provides a method of identification of a hearing aid, which solves the above problems.

Accordingly a method for identification of a hearing aid is provided, whereby a light emitting device at the hearing aid provides a light signal whenever the hearing aid is turned on, whereby the light signal is indicative for the left and right ear hearing aid respectively. The user has the need to know which hearing aid goes to which ear prior to applying the hearing aid to the ear, and according to the invention this information will be given when the hearing aid is turned on. All the user has to do is to turn on the hearing aid, and from the light emitted from the diodes it will be clear which ear the hearing aid belongs to.

In a further embodiment of the invention the light signal is caused to remain visible for a limited time after turning on the hearing aid. Once the hearing aid is correctly placed in the ear, the need for the indication on the hearing aid is no longer there and the indication signal can be turned off. Thus the indication signal is programmed to be switched off after having been turned on for a short duration of time.

Preferably the light signal is a coloured light which provides each its colour for left and right ear hearing aid respectively. Thus a well known colour code may be used for indicating wether the hearing aid is for the right or for the left ear.

In another embodiment the light is intermittent with each its intermittence for the left and right ear hearing aid respectively. This is advantageous in that a diode with only one colour may be used, which can be more cost effective. The different types of intermittence used for the left and right ear hearing aid can be as simple as a fast intermittence for left and a slow intermittence for the right ear hearing aid. A further advantage of this embodiment is that people with no or little colour vision may also benefit from the invention.

Preferably a combination of colour and intermittence is used to indicate which ear the hearing aid belongs to.

In an embodiment of the invention the intensity and the duration of the light signal after turning on the hearing aid is programmable. Thus this feature may be adapted for the need of the individual user. Some users may require clear and lengthy indication, while others might not need any indication at all, and the feature may be completely shut off, and the associated power consumption can be saved. This feature is obviously not so useful for people with a hearing aid on only one ear. Here the confusion as to at which side the hearing aid fits is not so likely to occur and the indicator light for indicating left or right ear hearing aid may be programmed to be non-functional, thus saving power, or allowing other types of useful information to be signalled with the light.

According to a further aspect of the invention a hearing aid is provided with visual identification of the identity of the hearing aid. The hearing aid comprises a programmable signal processor, a battery connectable to the signal processor, a light emitting element and a switch controllable from the signal processor. The signal processor comprise a timer function allowing the switching element to be activated for power supply to the light emitting element during a limited period upon connection of the battery to the signal processor. Such a hearing aid would aid to provide secure identification of the hearing aid just being turned on, so that the user knows wether it is a right or a left ear hearing aid. Further this indication is only present at the time when needed and is not visible at other times. A further advantage of the hearing aid according to the invention is that the light emitting element may be user at other times to indicate other functional aspects of the hearing aid.

Preferably the light emitting element is a multicolour diode whereby different colours are used for right and left ear hearing aid respectively. This allows very secure identification of the hearing aid.

The signal processor has a controller for controlling the colour of the light emitted from the diode, whereby the controller is programmable in order to allow the colour of the emitted light to be changed prior to the use of the hearing aid.

DESCRIPTION OF A PREFERRED EMBODIMENT

Figure 1:
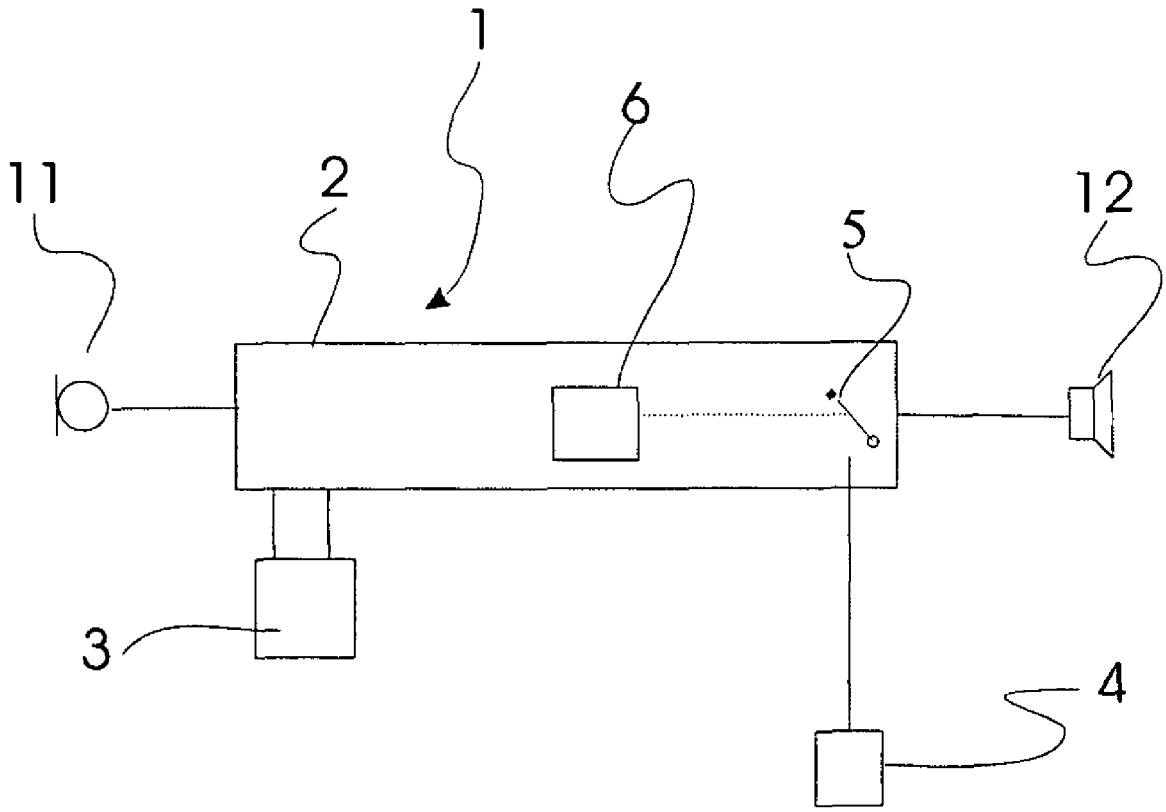
FIG. 1 is a schematic representation of a hearing aid according to the invention.

In FIG. 1 a hearing aid 1 is schematically displayed with a microphone 11, a receiver 12, a battery 3 and a signal processor 2. Further a light emitting element 4 is provided such that light radiated from the light emitting element is visible on the outside of the hearing aid. The battery is connected to the signal processor 2 to provide power for the signal processing and for delivery of the output signal to the receiver 12 and to the light emitting element 4. The Control of the power supply to the light emitting element 4 is provided by means of a switch 5. In the embodiment shown the switch is an integrated part of the signal processor, but it may also reside as a device outside the signal processor. A timer 6 is provided for control of the switch 5, such that it may be ensured that the light emitting element 4 is only active when the hearing aid has recently been turned on. This is important as it is only when the hearing aid is to be positioned on or in the ear that the user has the need to know whether the hearing aid is a left ear or right ear hearing aid. Thus the timer 6 is programmed to turn on the light in a given period after the hearing aid has been turned on, such that the user during this period may position the hearing aid at the ear according to the light emitted.

The light emitting element 4 can be any element emitting visible light when a suitable electric power signal is supplied. In an embodiment the element 4 is a diode, preferably a multicoloured diode. Thus the colour of the emitted light is controllable by the signal processor. The timer 6 and the colour thus becomes programmable, which makes the hearing aid very flexible and it may be adjusted to the needs of the user. Some users may not need any indication as to whether a hearing aid is for the right or for the left ear, and for such users the light emitting element may be used for indicating other kinds of information, or alternatively the light emitting element is disabled in order to save power. For other users the light indicator may be very important, especially for users, who rely on help from other people when the hearing aid is to be placed correctly at the ear. For such users a lengthy and powerful light signal should be provided to ensure correct placement of the hearing aid at the ear.

The invention claimed is:

1. A hearing aid comprising: a programmable signal processor (2);

a battery (3) connectable to the signal processor (2);

a light emitting element (4); and a switch (5) for controlling power supply to the light emitting element (4) controllable from the signal processor (2), wherein the signal processor (2) supplies a power signal to the light emitting element (4) so that the light emitting element provides a visual indication (4) of an identity of the hearing aid during a first time period, and the signal processor (2) supplies a power signal to the light emitting elements (4) so that the light emitting element (4) provides a visual indication of functionality of the hearing aid during a second time period.

2. The hearing aid as claimed in claim 1, whereby the light emitting device (4) provides a light signal when the hearing aid (1) is turned on, whereby the light signal provides visual indication that the hearing aid is left ear hearing aid or a right ear hearing aid.

3. The hearing aid as claimed in claim 2, whereby the light signal is caused to remain visible for a limited time after turning on the hearing aid.

4. The hearing aid as claimed in claim 2, whereby the light signal is a coloured light of a first colour indicating that the hearing aid is a left ear hearing aid or of a second colour indicating that the hearing aid is a right ear hearing aid.

5. The hearing aid as claimed in claim 2, whereby the light is intermittent with first intermittence indicating that the hearing aid is a left ear hearing aid or with second intermittence indicating that the hearing aid is a and right ear hearing aid.

6. The hearing aid as claimed in claim 5, wherein the intensity and the duration of the light signal are programmed after turning on the hearing aid.

7. The hearing aid as claimed in claim 1, wherein said signal processor (2) includes a timer (6) to allow the switch (5) to be activated for power supply to the light emitting element (4) during a limited period upon connection of the battery (3).

8. The hearing aid as claimed in claim 1, whereby the light emitting element (4) is a multicolour diode, wherein the signal processor (2) controls a colour of light emitted from the diode whereby light of a first colour is emitted from for the diode to provide visual indication that the hearing aid is a right ear hearing aid and light of a second colour is emitted from the diode to provide visual indication that the hearing aid is a left ear hearing aid.

9. The hearing aid as claimed in claim 8, wherein the signal processor (2) is programmable to allow the colour of the emitted light to be changed prior to the use of the hearing aid.

* * * * *